US007267599B2

(12) United States Patent
Allen et al.

(10) Patent No.: US 7,267,599 B2
(45) Date of Patent: Sep. 11, 2007

(54) DRAWSTRING BRA CUP

(76) Inventors: Marsha Marie Allen, 5250 S. Michigan Ave., 3rd Floor, Chicago, IL (US) 60615; Ruth Bell Allen-Rhymes, 5248 S. Michigan Ave., 3rd Floor, Chicago, IL (US) 60615

( * ) Notice: Subject to any disclaimer, the term of this patent is extended or adjusted under 35 U.S.C. 154(b) by 0 days.

(21) Appl. No.: 10/446,454

(22) Filed: May 29, 2003

(65) Prior Publication Data

US 2005/0277362 A1 Dec. 15, 2005

(51) Int. Cl.
*A41C 3/10* (2006.01)
*A41C 3/00* (2006.01)

(52) U.S. Cl. ..... 450/67; 450/68

(58) Field of Classification Search ..... 450/1, 450/36, 58, 59, 62, 63, 64, 67, 68, 69, 78; 2/67, 69, 73, 78.1–78.3, 105, 106
See application file for complete search history.

(56) References Cited

U.S. PATENT DOCUMENTS 1,590,693 A * 6/1926 McKeefrey ..... 450/61
2,016,614 A * 10/1935 Rawetzky ..... 450/68
2,175,676 A * 10/1939 Walters ..... 450/63
2,313,811 A * 3/1943 Dubner ..... 450/68
2,488,105 A * 11/1949 Weil ..... 450/68
2,497,324 A * 2/1950 Schenkman ..... 450/63
2,624,049 A * 1/1953 Granne ..... 2/114
3,200,821 A * 8/1965 Anderson ..... 450/68
5,971,834 A * 10/1999 Murray ..... 450/68

* cited by examiner

*Primary Examiner*—Gloria M. Hale

(57) ABSTRACT

The important feature of this invention is the breast cups. Each breast cup having a circumferential perimeter with a sewn in drawstring chamber about the entire circumferential perimeter; a drawstring secured within the drawstring chamber; a drawstring having a first end entering the chamber at an upper inside top edge of each breast cup at a base of an attached shoulder strap; the drawstring circumferentially surrounding the cup through a chamber and having a second end exiting at the bottom of the shoulder strap and a locking cord lock fastener to tighten and lock the drawstring to adjust the breast cups about a wearer's breast. The Drawstring Breast Cups are designed to offer the large breasted and overly heavy breasted females better support and the illusion of smaller breast size look. However, it is also suitable for the smaller breasted females seeking the illusion of fuller breast size look.

1 Claim, 4 Drawing Sheets

FIG. 5
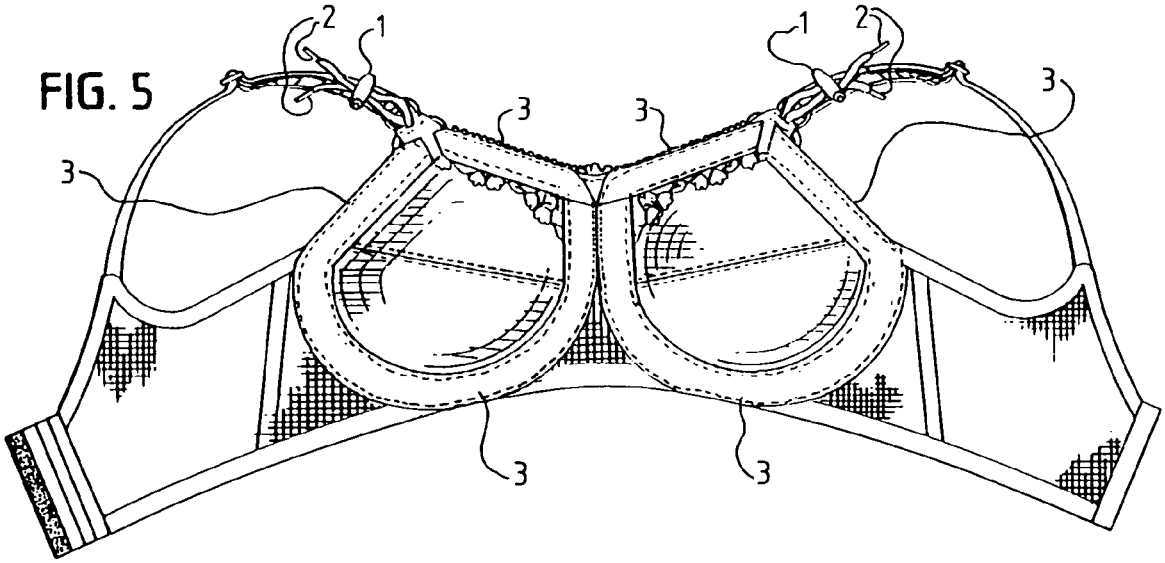
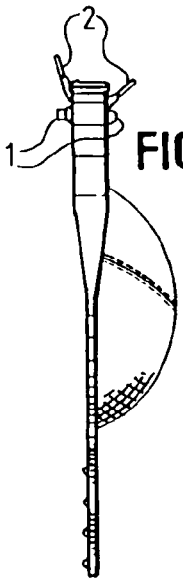
FIG. 6
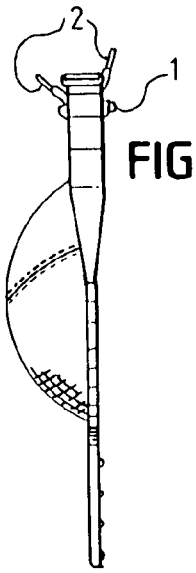
FIG. 7
FIG. 8
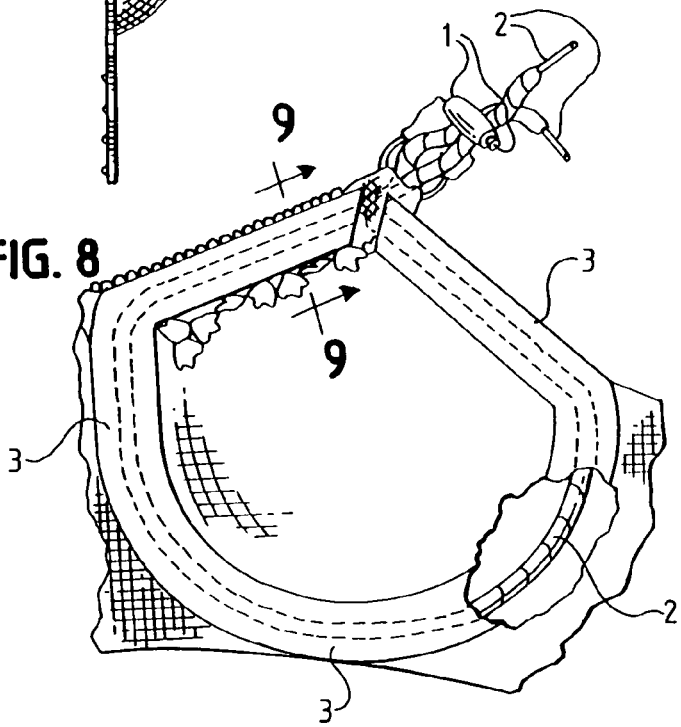
FIG. 9
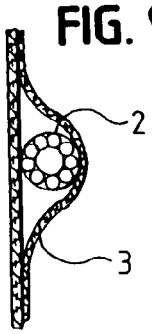

DRAWSTRING BRA CUP

CROSS-REFERENCE TO RELATED APPLICATION

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK

Not Applicable

BACKGROUND OF THE INVENTION

Our invention relates to the improvement in brassiere cups. Specifically, a brassiere having two breast cups; each said breast cup having a circumferential perimeter with a sewn in drawstring chamber about said entire circumferential perimeter; a drawstring secured within said drawstring chamber; said drawstring having a first end entering said chamber at an upper inside top edge of each breast cup at a base of an attached shoulder strap; said drawstring circumferentially surrounding said cup through said chamber and having a second end exiting at the bottom of said shoulder strap; both said first end and said second end extending through a locking cord lock fastener which includes a fastener mechanism to tighten and lock said drawstring there through in order to circumferentially adjust said breast cups about a wearer's breast for improved fit, comfort and aesthetics to create a smaller breast size look for a large breasted woman and the illusion of larger breasts for a small breasted woman. Brassiere designers have commonly manufactured their bra cups with underwire (metal or plastic) to support and shape the breast. Unfortunately, these devices do not allow the wearer to adjust the cups. The bra designers in prior art manufacturer bras in massed production which is not bad, however, females have variances breast types or texture due to natural growth, pregnancy, childbirth, nursing, and/or aging. They provide a symmetrical bra cup that is suppose to fit most women breast size. This type of profiling does not allow the wearer the freedom of bra cup size adjustment.

We sought to fill this void by designing breast cups that will provide for custom fit. Some large breasted females and overly heavy breasted females have long looked for a bra that would make the breast less noticeable. Eliminating the metal or plastic underwire to lessen bruising under the armpits and under the lower rib cage from the wire poking or resting to tight against the skin, is what we have sought to do. Our breast cups works with the natural flow of gravity; uplifting. Even though, some of the prior art in their recent designs have attempted to address this problem, there is still a need in the bra cups designs for improvement. U.S. Pat. No. 6,439,960, U.S. Pat. No. 6,375,538, U.S. Pat. No. 5,215,494 and U.S. Pat. No. 5,816,889.

BRIEF SUMMARY OF THE INVENTION

In accordance with the present invention, a brassiere having two breast cups; each said breast cup having a circumferential perimeter with a sewn in drawstring chamber about said entire circumferential perimeter; a drawstring secured within said drawstring chamber; said drawstring having a first end entering said chamber at an upper inside top edge of each breast cup at a base of an attached shoulder strap; said drawstring circumferentially surrounding said cup through said chamber and having a second end exiting at the bottom of said shoulder strap; both said first end and said second end extending through a locking cord lock fastener which includes a fastener mechanism to tighten and lock said drawstring there through in order to circumferentially adjust said breast cups about a wearer's breast for improved fit, comfort and aesthetics to create a smaller breast size look for a large breasted woman and the illusion of larger breasts for a small breasted woman. The advantages and object of this present invention is:

(a) to create breast cups in such a manner that it lifts the breast upward, limiting the sagging of the breast which in turn will cause less stress on the straps;

(b) to create breast cups that configures the breast tissue (eliminating wire or plastic) creating a smaller breast size look for a large breasted woman and the illusion of larger breasts for a small breasted woman and;

(c) to create breast cups having a circumferential perimeter with a sewn in drawstring chamber surrounding the entire breast to help decrease excessive breast movement.

Further advantages and object is to provide the wearer with breast cups that are easily adjusted for the desired fit, comfort, and easy removal of the drawstrings.

BRIEF DESCRIPTION OF THE DRAWINGS

Reference being made to the following drawings:

FIG. 5 shows the rear elevation of the bra.

FIG. 6 shows the left side elevation of the bra.

FIG. 7 shows the right elevation of the bra.

FIG. 8 shows the fragmentary elevation of the bra.

FIG. 9 shows the cross section taken from 9-9 of FIG. 8

REFERENCE NUMERALS IN DRAWINGS

1 locking cord lock fastener
2 drawstring
3 drawstring chamber
4 breast cup
5 arrow (displays reduction and lifting in breast cup)

DETAILED DESCRIPTION OF THE INVENTION—FIGS. 1, 2, 3, 4, 5, 6, 7, 8, 9, 10, 11, 12, 13 AND 14

Figure 1:
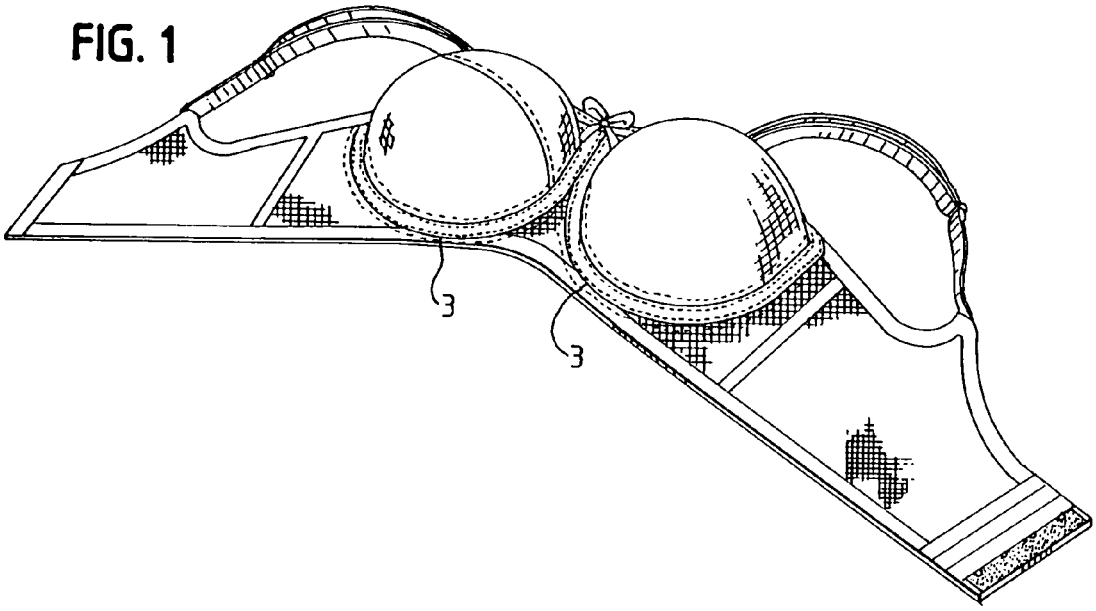
FIG. 1 shows the perspective of the bra.
Figure 2:
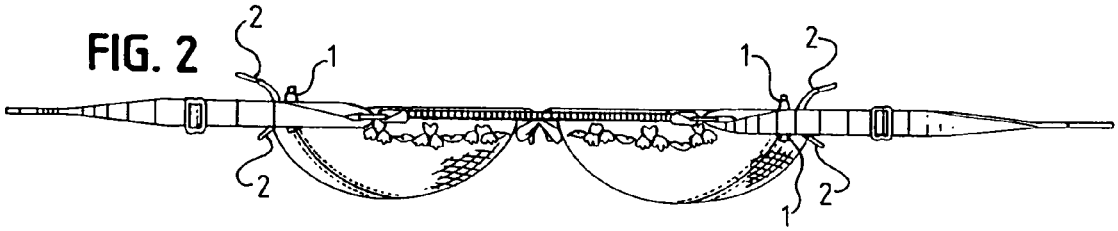
FIG. 2 shows the top plan of the bra.
Figure 3:
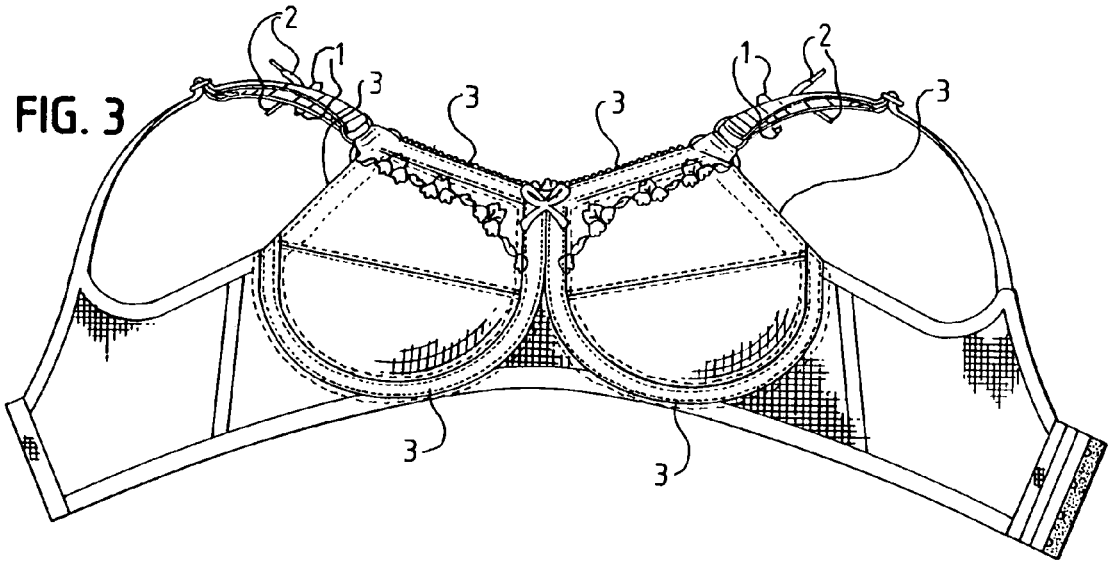
FIG. 3 shows the front elevation of the bra.
Figure 4:
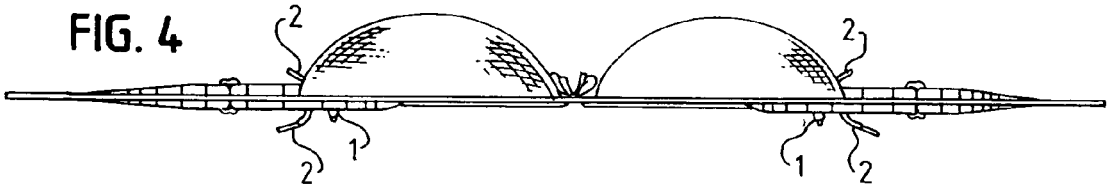
FIG. 4 shows the bottom plan of the bra.
Figure 10:
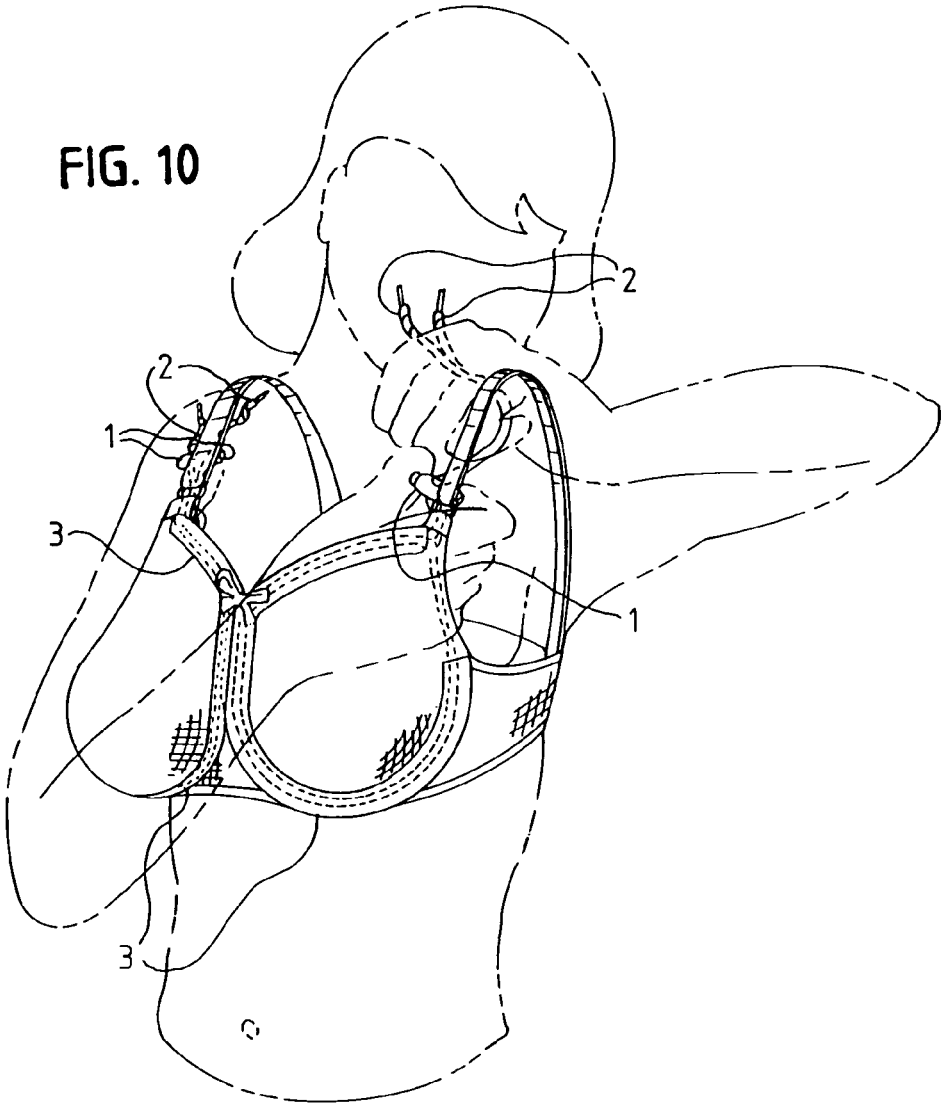
FIG. 10 shows the perspective in use.
Figure 11:
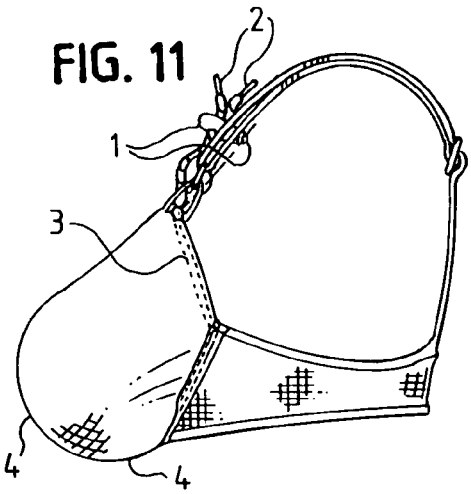
FIG. 11 shows the left side elevation not in use
Figure 12:
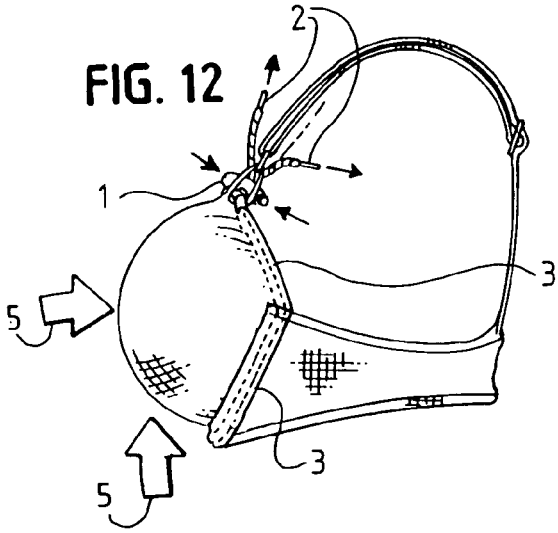
FIG. 12 shows the left side elevation in use
Figure 13:
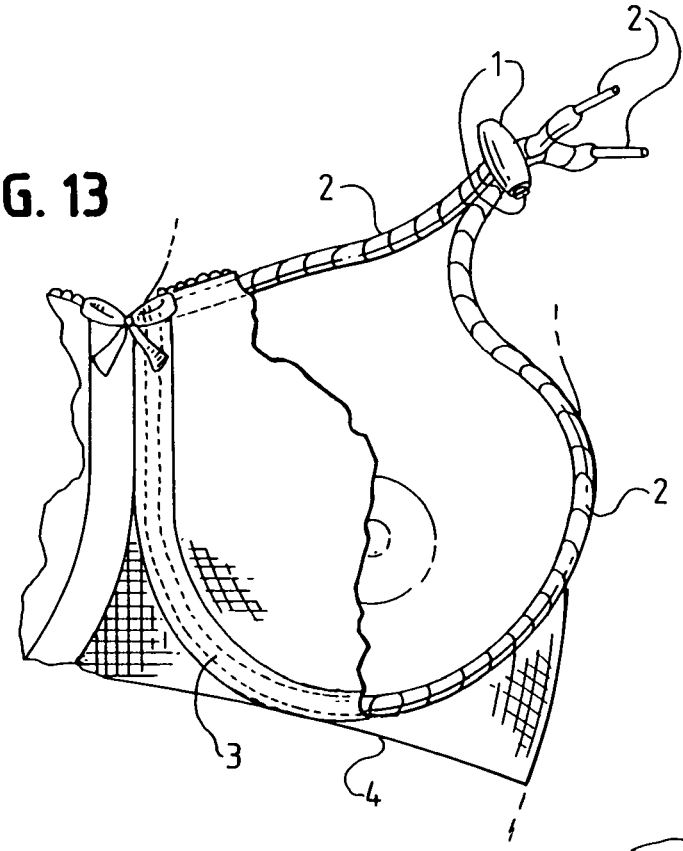
FIG. 13 shows the fragmentary front view not in use (drawstring not tightened)
Figure 14:
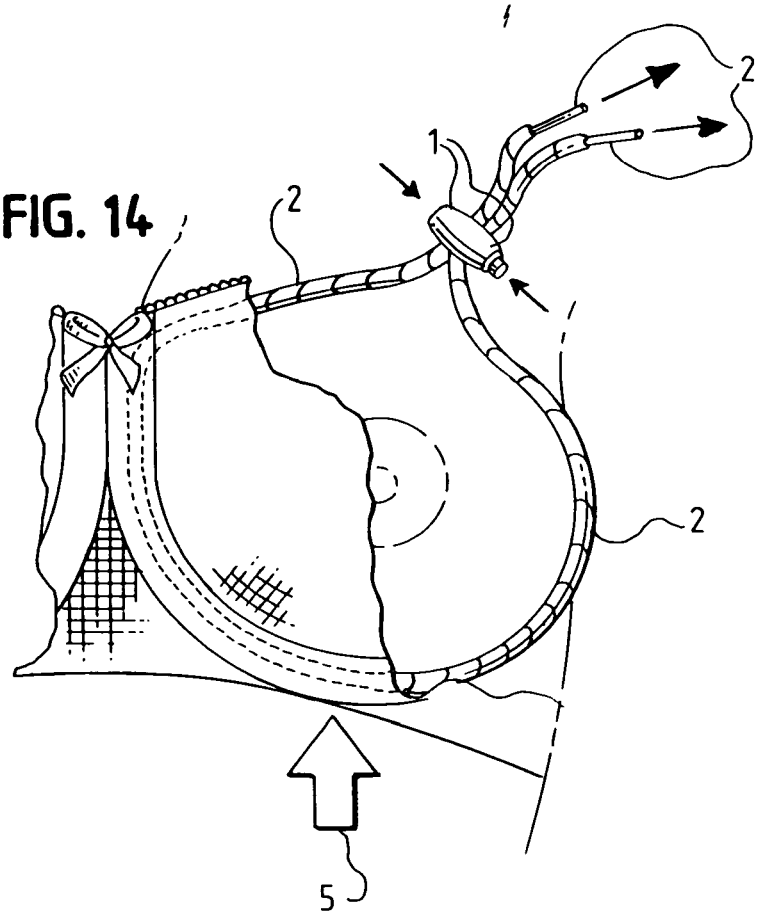
FIG. 14 shows the fragmentary front view in use (drawstring is tightened)

Referring now to the drawing, and in particular FIGS. 1-5 thereof, illustrates a conventional looking brassiere at first view with the exception of our present invention, the drawstring 2 and locking cord lock fastener 1 which includes a fastener mechanism to tighten and lock said drawstring 2. A drawstring 2 secured within said sewn in drawstring chamber 3 surrounding the entire circumferential perimeter of the breast cups 4 and said drawstring 2 having a first end entering said chamber at an upper inside top edge of each breast cup at a base of an attached shoulder strap; said drawstring circumferentially surrounding said cup through said chamber and having a second end exiting at the bottom of said shoulder strap both said first end and said second end extending through a locking cord lock fastener 1 which includes a fastener mechanism to tighten and lock said drawstring 2. FIGS. 6 and 7 shows the right and left elevation of the breast cups 4 displaying how the drawstring 2 exits through the locking cord lock fastener 1 which includes a fastener mechanism to tighten and lock said drawstring 2. FIG. 8 shows the fragmentary elevation of one breast cup 4 displaying partial transparence of how the drawstring 2 look inside the drawstring chamber 3 with the drawstring 2 not being tightened but hanging loosely at the top of the breast cup 4 having a first end entering and having a second end exiting through the locking cord lock fastener 1 which includes a fastener mechanism to tighten and lock said drawstring 1. FIG. 9 is 9-9, the cross section inside view of FIG. 8 revealing the drawstring 2 inside of the circumferential perimeter of the sewn in drawstring chamber 3. FIG. 10 gives an outline of a female wearer tightening the drawstring 2 through the locking cord lock fastener 1 of the left breast cup 4 for the desired fit and comfort with the right side of the breast cup 4 displaying the sewn in drawstring chamber 3 and the drawstring 2 having a first end entering and having a second end exiting through the locking cord lock fastener 1 which includes a fastener mechanism to tighten and lock said drawstring 1 not yet being tightened. FIG. 11 is the left side view of the breast cup 4 without tightening on the drawstring 2 and the drawstring 2 having a first end entering and having a second end exiting the locking cord lock fastener 1 which includes a fastener mechanism to tighten and lock said drawstring 2. FIG. 12 also is the left side view of the breast cup 4 with the exception of a middle arrow 5 and lower arrow 5 indicating that the breast cup 4 has been reduced in size and the breast has lifted upwards when the drawstring 2 has been tightened and the drawstring 2 having a first end entering and having a second end exiting through the locking cord lock fastener 1 which includes a fastener mechanism to tighten and lock said drawstring 2 causing the locking cord fastener 1 to slide closer to the upper inside top edge of the breast cup 4. FIG. 13 displays a partial view of the left breast inside of the transparent breast cup 4 which reveals how the drawstring 2 circumferentially surrounds the entire breast inside of the circumferential perimeter of the sewn in drawstring chamber 3 having a first end entering and having a second end exiting through the locking cord lock fastener 1 which includes a fastener mechanism to tighten and lock said drawstring 2 that has not been tightened. FIG. 14 is a mirror of FIG. 13 with the exception of the breast size and breast cup 4 appearing smaller due to the drawstring 2 having been tightened through the locking cord lock fastener 1 which includes a fastener mechanism to tighten and lock said drawstring 2 and arrow 5 which indicates a reduction in breast cup 4 size between FIGS. 13 & 14.

We claim:

1. A brassiere having two breast cups; each said breast cup having a circumferential perimeter with a sewn in drawstring chamber about said entire circumferential perimeter; a drawstring secured within said drawstring chamber; said drawstring having a first end entering said chamber at an upper inside top edge of each breast cup at a base of an attached shoulder strap; said drawstring circumferentially surrounding said cup through said chamber and having a second end exiting at the bottom of said shoulder strap; both said first end and said second end extending through a locking cord lock fastener which includes a fastener mechanism to tighten and lock said drawstring there through in order to circumferentially adjust said breast cups about a wearer's breast for improved fit, comfort and aesthetics to create a smaller breast size look for a large breasted woman and the illusion of larger breasts for a small breasted woman.

* * * * *